US005189795A

United States Patent [19]

Fortin

[11] Patent Number: 5,189,795

[45] Date of Patent: Mar. 2, 1993

[54] PRECISION LINOLEUM EDGE TRIMMING TOOL

[76] Inventor: Conrad Fortin, 534 Main St., Van Buren, Me. 04785

[21] Appl. No.: 844,560

[22] Filed: Feb. 2, 1992

[51] Int. Cl.[5] ..... B26B 29/00; B26B 29/02; B26B 27/00

[52] U.S. Cl. ..... 30/294; 30/287; 30/293

[58] Field of Search ..... 30/263, 273, 293, 287, 30/294, 306, 319

[56] References Cited

U.S. PATENT DOCUMENTS

| | | | |
|---|---|---|---|
| 3,382,579 | 5/1968 | Prater | 30/329 |
| 3,395,453 | 8/1968 | Prater | 30/293 |
| 4,130,939 | 12/1978 | Toal | 30/294 |
| 4,262,418 | 4/1981 | Hill et al. | 30/287 |
| 4,354,314 | 10/1982 | Pierce | 30/294 |
| 4,549,351 | 10/1985 | Stanbery et al. | 30/293 |
| 4,648,181 | 3/1987 | Fortin | 30/293 |
| 5,044,081 | 9/1991 | Nguyen | 30/294 |

FOREIGN PATENT DOCUMENTS

| | | | |
|---|---|---|---|
| 8801141 | 12/1989 | Netherlands | 30/294 |

*Primary Examiner*—Douglas D. Watts
*Assistant Examiner*—Paul M. Heyrana
*Attorney, Agent, or Firm*—Daniel H. Kane

[57] ABSTRACT

A tool for trimming edge portions of linoleum to fit against a bordering wall has leading and trailing ends and a downwardly opening throat which extends lengthwise of the tool and opens through the ends thereof. The throat is dimensioned to enable an edge portion of the thickest and stiffest linoleum to be entered in and pass through the throat and be held upwardly curved against the outer wall of the throat as the tool is advanced along the wall with spaced edge portions in engagement with the wall at its junction with the floor or a covering thereon and disposed to hold the front of the tool out of contact with the wall or a baseboard. The tool has a holder for a blade exposed in the throat in the trailing end and disposed to sever the edge portion against the outer or front wall of the throat as the tool is advanced.

10 Claims, 4 Drawing Sheets

PRECISION LINOLEUM EDGE TRIMMING TOOL

TECHNICAL FIELD

This invention relates to a new, hand held tool for use in precision trimming the edges of linoleum strips which are to butt against walls.

BACKGROUND ART

Commercial grade linoleum is available in lengths which are six feet wide so that almost always the last strip to be laid on the floor of a room or a covering theron must be carefully trimmed to fit against the bordering walls.

In order to effect such trimming, the strip usually is cut to provide an edge portion which, while still needing to be carefully trimmed, is dimensioned to lay curved upwardly to a limited extent against the wall or baseboard.

In order that such a rough cut margin may be more conveniently trimmed than by means of a hand held knife, a tool is available to assist the installer, see U.S. Pat. Nos. 3,382,579 and 3,395,453. Such a tool is designed to be manually held and slid along the material, linoleum or carpeting, with a member holding the margin to be trimmed flat against the wall or baseboard with a resulting narrow curved junction between the held material and that underlying the tool. The tool has a knife adjacent each end with that one which is at the trailing end when the tool is in use, exposed through a slot in the holding member in a position to sever the material close to the held margin.

Such a tool cannot be used where the material is insufficiently flexible to be curved sharply upwardly against the wall with a radius at the junction such as the use of that tool requires.

THE PRESENT INVENTION

The general objective of the present invention is to provide a tool enabling the heaviest and stiffest linoleum as well as the more flexible, lighter linoleum lengths and carpeting to be edge trimmed more easily and accurately, than has been possible prior to the present invention.

In accordance with one aspect of this invention, a tool is provided having leading and trailing ends and a downwardly opening throat at its front or wall-facing side. The throat opens through both ends and is shaped and dimensioned to receive an edge portion of the thickest, least flexible linoleum available at the present time and to maintain that edge portion curved upwardly against the outer or front wall of the throat thus enabling the tool to be manually guided lengthwise of the wall of a building against which the trimmed edge is to be fitted with the edge portion passing lengthwise through the throat.

The tool is provided with a blade holder rearwardly of the throat with both throat walls having slots into which a blade, held by the holder extends with its cutting edge exposed in the trailing end of the tool to sever the edge portion of the linoleum passing lengthwise through the throat as the tool is advanced lengthwise along the wall. The distance between the upper side of the blade receiving slot in the inner or rear wall of the throat and a line parallel to the throat and rearwardly thereof as measured along the inner surface of that wall is equal, when the tool is positioned for use, to the shortest distance between that line and the wall of the building thus ensuring a snug fit of the trimmed edge.

Another objective of the invention is to enable the trimmed edge of the linoleum to be inclined rearwardly with respect to the tread surface thereof and is attained with the blade receiving slots appropriately inclined with respect to the curved linoleum.

Another aspect of the invention is to provide each end of the tool with a right angular bracket with one bracket arm extending beyond the rear or inner wall of the throat and the other bracket arm depending and having an end disposed, when the tool is operatively positioned, to rest on the floor or a covering thereon and butt against the wall. The upper portions of the depending arms constitute corresponding parts of the outer throat wall and a lengthwise member connected to the lower portions of the depending arms has its inner surface appropriately curved to complete the outer or front wall of the throat. An important feature of the depending bracket arms is that their ends are so disposed that when butted against the wall, the tool is spaced from that wall as it is slid lengthwise thereof.

Other objectives of the invention and the manner of their attainment will be apparent from the accompanying drawings, the detailed description thereof and the claims.

BRIEF DESCRIPTION OF THE DRAWINGS

The accompanying drawings illustrate a presently preferred embodiment of a tool in accordance with the invention

THE PREFERRED EMBODIMENT

Figure 1:
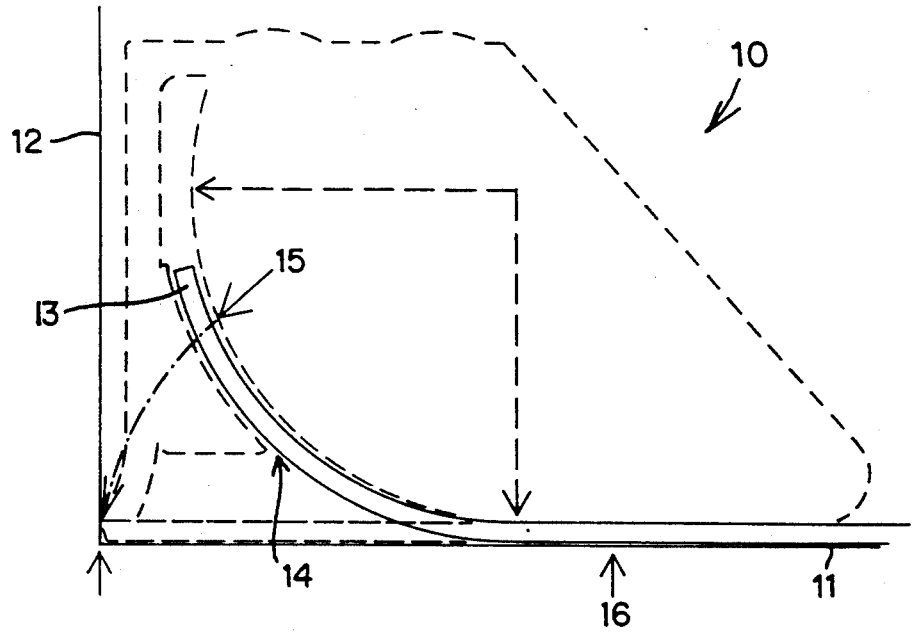
FIG. 1 is a schematic view illustrating essential features of the tool and its position of use.

Reference is first made to FIG. 1 in which the tool is generally indicated at 10 and is shown in its operative position on the floor 11 and spaced a predetermined distance from the bordering wall 12 against which a margin 13 of the linoleum sheet, when trimmed is to be snugly fitted.

To achieve precision trimming of the margin 13, the tool 10 is provided with a throat, generally indicated at 14, which opens downwardly and rearwardly as well as through both ends thus to enable the marginal portion of the linoleum sheet to be entered into it and to pass through it as the tool, in its operative position, is slid lengthwise of the wall 12.

It will be seen that the throat 14 holds the margin 13 upwardly curved and seated against the forward or front wall of the throat. The throat is wide enough to accommodate the thickest and stiffest linoleum now on the market as well as thinner linoleum sheets and carpeting with the throat defining an arc of 90°. In practise, the radius of the arc is two inches establishing a curvature to which the thickest, stiffest linoleum readily conforms.

The margin of the lineoleum 13 is to be severed in along a straight line lengthwise of the throat zone 15 with the shortest distance from the line of severance as measured along the front wall of the throat to any line 16 on the undersurface of the tool 10 and parallel to the severance line but rearwardly thereof equal to the shortest distance from the wall 12 to the line 16 ensuring a snug fit of the trimmed margin against the wall 12.

With the above features of the tool 10 in mind, the details and functions of the tool will be more readily appreciated.

The tool 10 has leading and trailing end walls 17 and 18, respectively, both of the same size and shape but with the end wall 18 shown as thicker than the end wall 17. Both walls have flat surfaced, parallel top and bottom edges 19 and 20, respectively, joined by a rear edge 21 which is downwardly and rearwardly inclined and an arcuate front edge 22 shown as more than 90° in extent and having a two inch radius where the maximum thickness of the linoleum is three thirty seconds of an inch.

The end walls 17 and 18 are connected to the opposite ends of a base 23 the bottom edge of which is of a configuration such that its bottom edge 24 is flush with the bottom edges 20 of the end walls and an arcuate end 25 flush with the lower part of their arcuate edges 22. The arcuate edges of the walls 17 and 18 and of the base 23 constitute the inner or rear wall of the throat 14.

Each end wall 17, 18 has an arm 26 of a rectangular bracket secured to its top 19 with the arm 26 extending beyond the upper end of the arcuate edge 22. The other bracket arm 27 depends and is of a length to engage the floor 11 when the tool is operatively positioned with its free end 28 disposed then to engage the wall 12 and space the tool 10 therefrom.

A member 29 has its end secured to the inner or rear sides of the arm 27 with its rear face arcuate with respect to the inner or rear wall of the throat 14. The member 29 and the portions of the depending bracket arms 27 above it constitute the outer wall of the throat 14.

Figure 8:
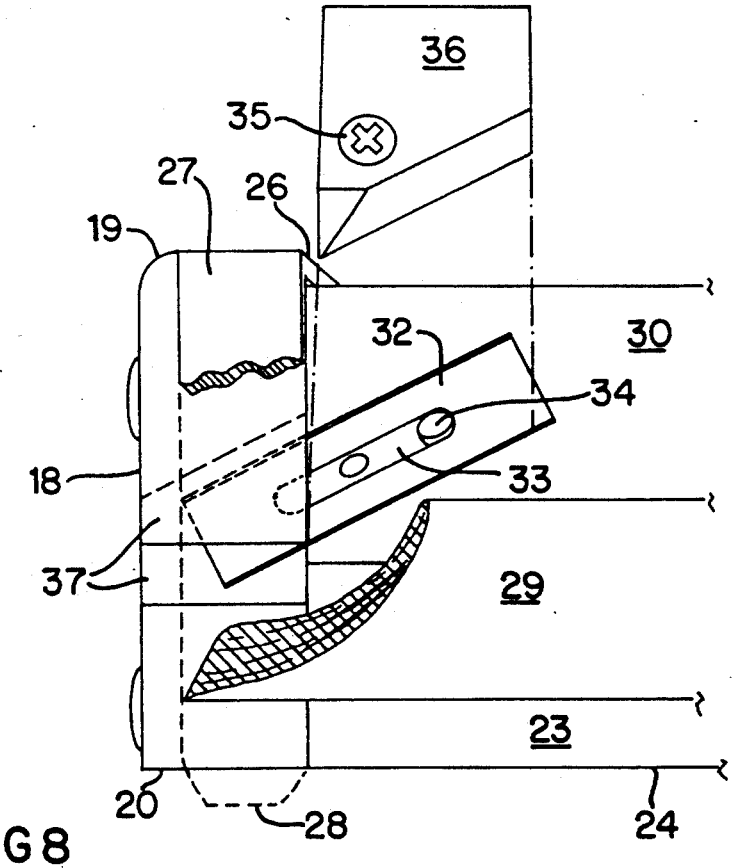
FIG. 8 is a fragmentary and partly sectioned view showing the lengthwise position of the blade relative to the throat.

In order to trim the margin 13, the tool 10 has a blade holder 30 pivotally connected to the end walls 17, 18 and is provided with a seat 31 for a blade 32 shown as having a central, lengthwise slot 33, see FIG. 8. The seat 31 has a stud or pin 34 located to enter the slot 33 of the seated blade 32 and is releaseably locked in position by a screw 35 extending through the clamp 36 the slot 33 in a position spaced from the centering pin 34, and into the blade holder 30.

Figure 4:
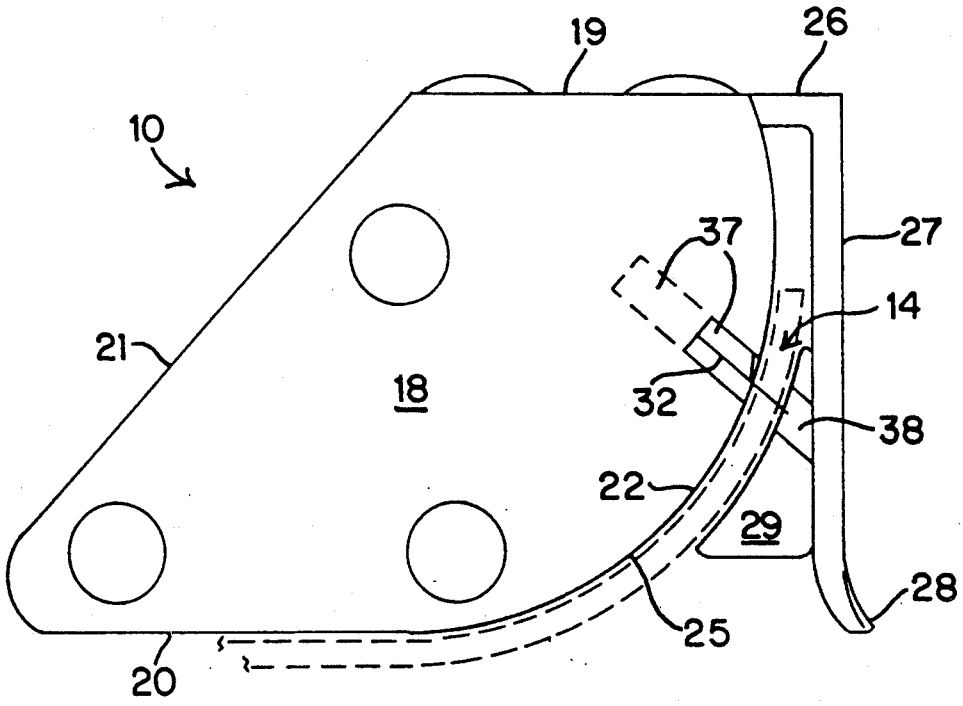
FIG. 4 is a view of the trailing end thereof with its upstream side exposed.

When the blade is clamped to its seat 31, a cutting portion extends through the slot 37 in the inner or rear wall of the throat 14 and into a slot 38 in the outer or front wall thereof, both slots close to the end wall 18. It will be noted, see FIGS. 1 and 4, that the blade 32 is so held that the trimmed edge is so bevelled that the trimmed edge is inclined rearwardly with respect to the tread surface of the material. It will also be noted from FIG. 8 that the cutting edge of the blade 32 is rearwardly inclined.

The blade holder 30, being pivotally connected to the end walls 16 and 17, may be swung upwardly and downwardly with the attendant raising and lowering the blade 32 within the limits imposed by the upper and lower walls of the slots 37 and 38 with the snuggest fit of a trimmed edge attained when the blade 32 engaged the upper walls of the slots.

Figure 2:
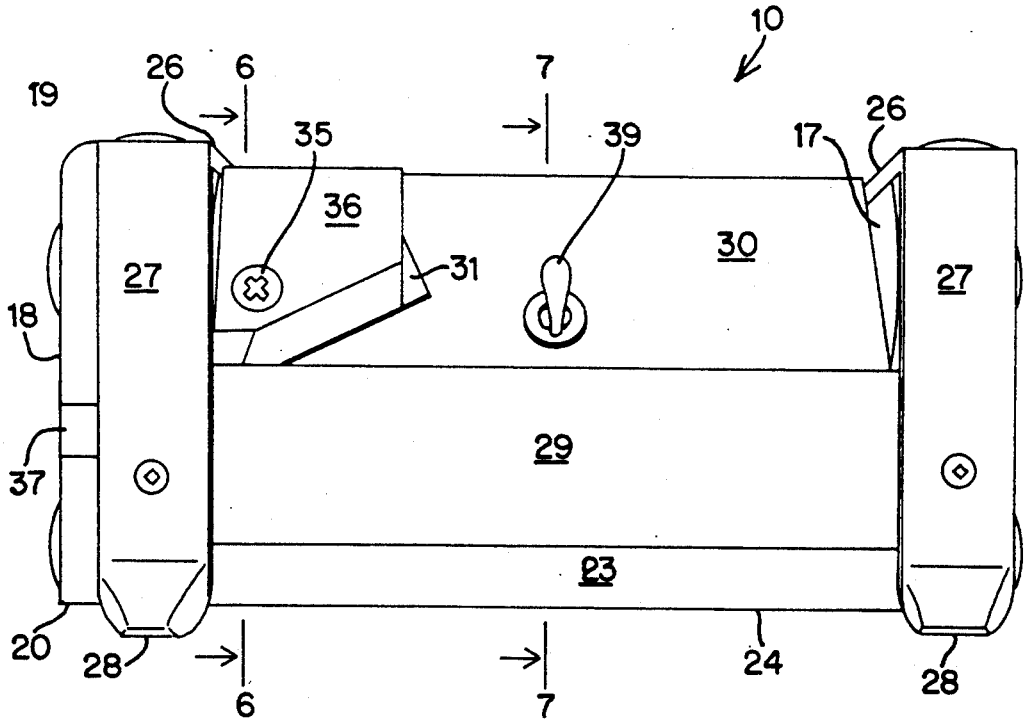
FIG. 2 is a front view of the tool.
Figure 3:
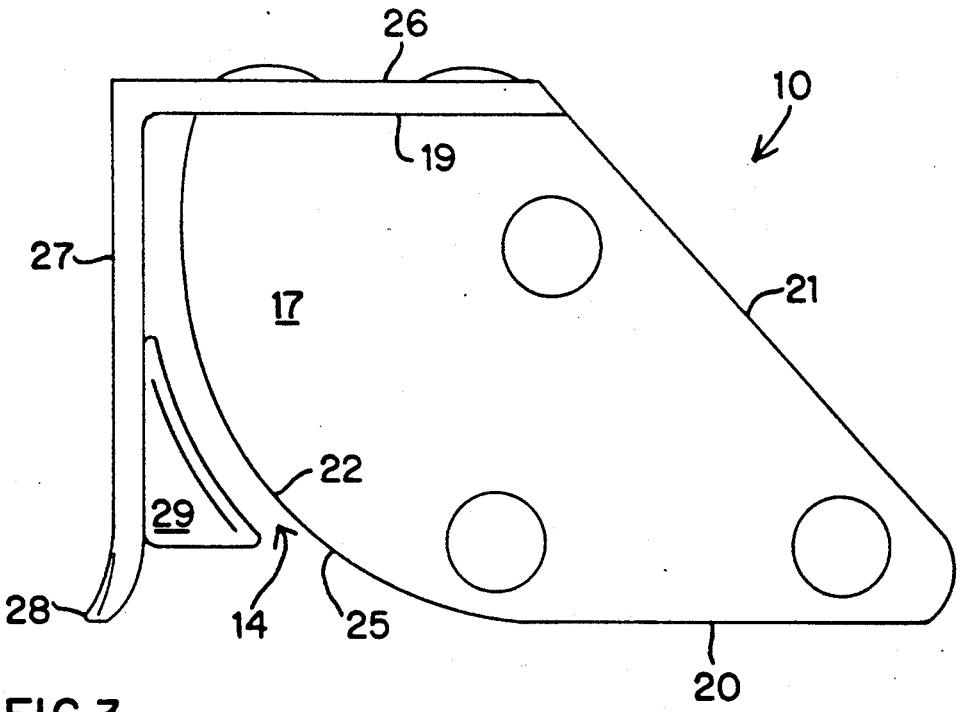
FIG. 3 is a view of the leading end of the tool.
Figure 5:
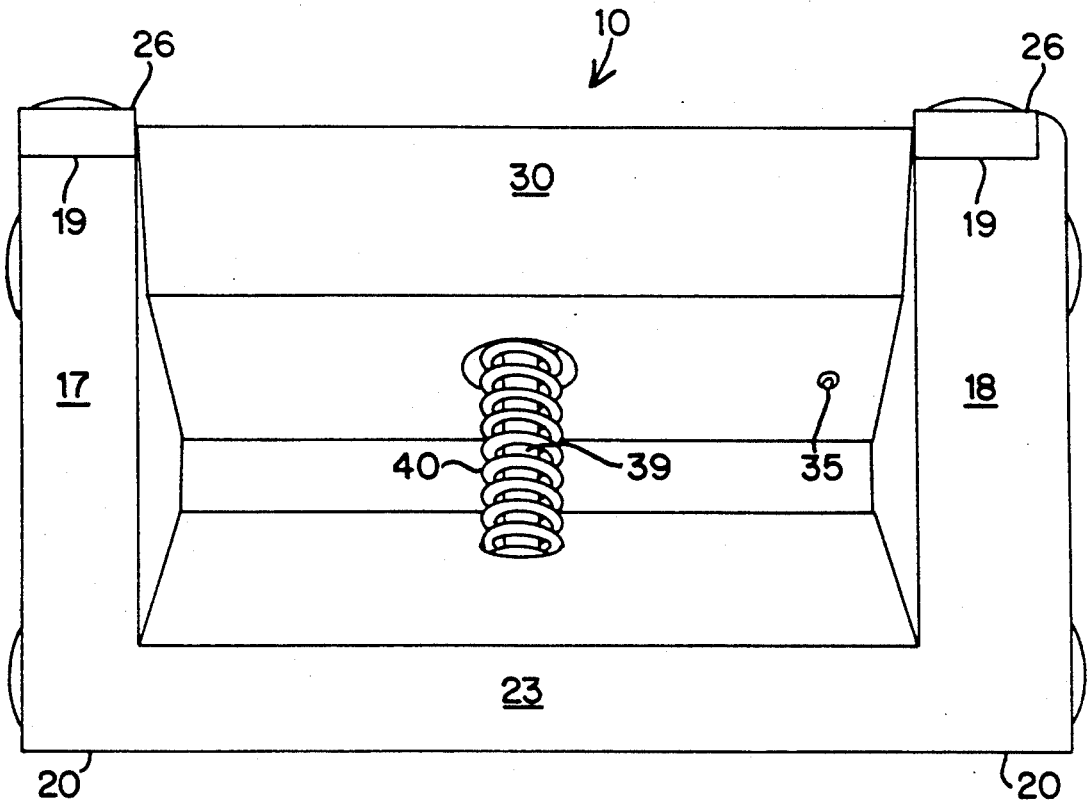
FIG. 5 is a view of the rear or back of the tool.
Figure 6:
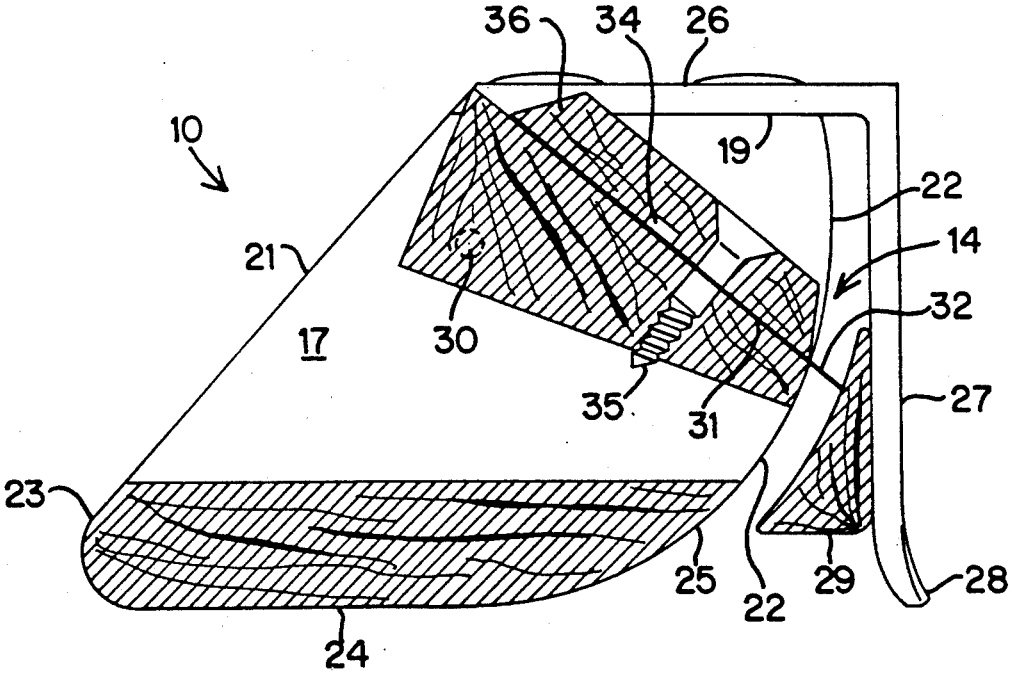
FIG. 6 is a section taken approximately along the indicated line 6—6 of FIG. 2.
Figure 7:
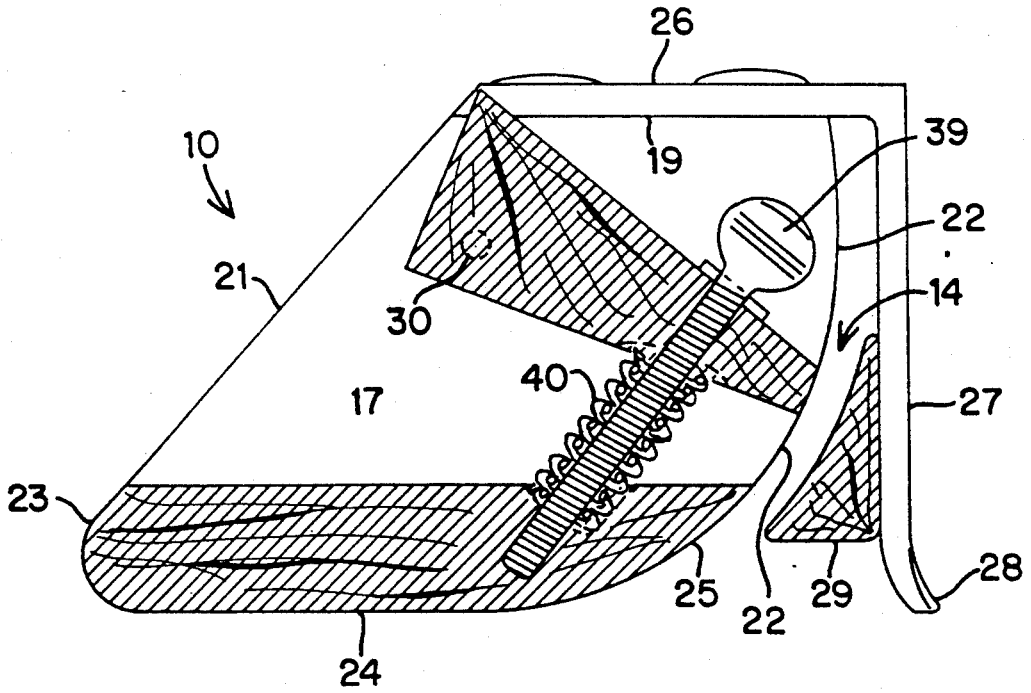
FIG. 7 is a section taken approximately along the indicated line 7—7 of FIG. 2.

Adjustments of the holder 30 are effected by means of a thumb screw 39, see FIGS. 2, 5 and 7, extending through the holder 30, through a compression spring 40 between the holder 30 and the base 23 and threaded into the base.

From the foregoing it will be apparent that the tool 10 is well adapted for use in the precision trimming of relatively thick and stiff materials. The throat 14 is adapted to accommodate edge portions of thinner materials as well. With the blade exposed at the trailing end of the tool, the trimming is effected with the material being cut backed by the front wall of the throat as the tool is pulled lengthwise of the bordering wall. At the same time, the fact that the tool is held spaced from the wall at both its leading and trailing ends ensures that minor irregularities of the wall or baseboard have minimum effect on the trimming.

I claim:

1. A tool for use in trimming an edge portion of a length of a floor covering such as linoleum to fit against a wall of a building, said tool including leading and trailing ends having portions for sliding contact with the floor or an existing covering thereon and front edges for sliding contact with the wall at the junction therewith of the floor or a floor covering thereon when the tool is in an operative position, a downwardly and rearwardly opening throat also opening through the ends of the tool and having front and rear walls connected to the ends, the throat walls spaced to enable an edge portion of the covering of predetermined maximum thickness to enter and pass transversely through the throat as the tool is slid forwardly while in said position, said throat walls so shaped that such edge portions within and passing through the throat are maintained curved upwardly against the front wall, said throat walls provided with lengthwise slots where edge portions of the material are held against the front wall within a line of severance, a holder having a seat, a connection between the holder and the ends of the tool, a blade having an elongated cutting edge, a releaseable connection between the blade and the seat holding the blade in the slots with its cutting edge in a position to sever the edge portion of the covering against the front wall as the tool is advanced in said operative position and with the shortest distance between the blade and any line, parallel to the cutting line of severance, on the undersurface of said portions, as measured thereto along the front wall of the throat, equal to the shortest distance between the building wall and said line, a wanted fit of the trimmed edge is ensured.

2. The tool of claim 1 in which the blade is held by the holder with the cutting edge thereof extending into the trailing end and is rearwardly inclined.

3. The tool of claim 2 in which the wall of the trailing end has a slot extending therethrough in the plane of the seat to accommodate the trailing end of the blade.

4. The tool of claim 2 in which the blade receiving slots of the throat are located as to so intersect the throat as to effect a bevelled trimmed edge, the bevel inclined rearwardly with respect to the tread surface of the covering.

5. The tool of claim 2 in which the side walls of the slots are spaced apart a distance greater than the thickness of the blade and the connection between the holder enables the holder to be moved to place the blade with the cutting edge thereof in a selected cutting position relative to the side walls with the blade against the upper walls to effect maximum snugness of the fit of the trimmed edge against the wall and against the lower walls to effect a fit of maximum looseness.

6. The tool of claim 1 in which the front edges, when in the operative tool position, space the tool from the wall.

7. The tool of claim 1 in which each end includes a wall having a flat surfaced bottom an arcuate outer edge which is part of the inner wall of the throat, a flat surfaced top and a rear wall, and a bracket one arm of which is secured to the top and which extends outwardly beyond the curved end, the other arm of the bracket depends and constitutes part of the front wall of the throat, the free end of the depending arm terminating in a side edge in a plane inclusive of the bottoms of the end walls disposed to space the remainder of that arm out of contact with the wall of the building, and a member connected to the lower portions of the depending arms has an arcuate surface constituting the remainder of the front wall of the throat.

8. The tool of claim 7 in which a base flush with the bottom edges of the end walls is connected thereto and includes an arcuate front edge flush with the lower portions of the arcuate edges of the end walls and constitutes a part of the rear throat wall.

9. The tool of claim 8 in which one end of the holder is pivotally connected to the end walls adjacent the inner ends of their flat tops and is downwardly inclined towards the blade slots in a spaced relationship with the rear wall of the throat and a threaded connection between the holder and the base is operable to swing the holder to adjust the position of the blade relative to the side walls of the slots.

10. The tool of claim 9 in which the walls of the throat are arcuate with a radius appropriate for the bending of linoleum of the maximum thickness and stiffness.

* * * * *